United States Patent [19]

Churchland

[11] 4,020,311

[45] Apr. 26, 1977

[54] MICROWAVE POWER APPLICATOR

[75] Inventor: Mark T. Churchland, Burnaby, Canada

[73] Assignee: MacMillan Bloedel Limited, Vancouver, Canada

[22] Filed: Sept. 15, 1975

[21] Appl. No.: 613,454

[52] U.S. Cl. ..... 219/10.55 A; 219/10.55 F

[51] Int. Cl.[2] ..... H05B 5/00

[58] Field of Search ..... 219/10.55 F, 10.55 A, 219/10.55 M, 10.55 B

[56] References Cited

UNITED STATES PATENTS

| | | | |
|---|---|---|---|
| 3,478,188 | 11/1969 | White | 219/10.55 A |
| 3,771,234 | 11/1973 | Forster et al. | 219/10.55 M |

FOREIGN PATENTS OR APPLICATIONS

| | | | |
|---|---|---|---|
| 836,140 | 3/1970 | Canada | 219/10.55 A |

*Primary Examiner*—Arthur T. Grimley
*Attorney, Agent, or Firm*—Sim & McBurney

[57] ABSTRACT

A microwave power applicator comprises a central tube through which the work piece is adapted to pass and two, hollow waveguide sections located on opposite sides thereof and communicating with the central tube to introduce microwaves into it. A microwave power source or sources is or are connected to the waveguide sections. The frequency of the microwaves, the width of the central tube measured between the waveguide sections and the angles of inclination of the latter with respect to the central tube are selected so as to create interleaved reflection standing wave patterns so as to uniformly distribute hot spots across the central tube.

10 Claims, 3 Drawing Figures

MICROWAVE POWER APPLICATOR

BACKGROUND OF THE INVENTION

This invention relates to microwave power applicators, i.e., to devices for applying microwave power to workpieces. More particularly, this invention relates to microwave power applicators designed so as to substantially uniformly distribute hot spots which occur due to reflection standing wave patterns.

From a commercial point of view microwave energy usually is applied in one of three ways, namely resonant cavity ovens, waveguide applicators and horn type antenna applicators.

In resonant cavity ovens energy in the form of microwave radiation is fed into a totally enclosed metal box having dimensions suitable for supporting standing waves. The material to be heated is placed in the applicator and necessarily has smaller dimensions than those of the box. This type of applicator suffers from the disadvantages that heating is not even, pressure cannot be applied conveniently to the workpiece, and the workpiece cannot be added continuously to or removed continuously from the oven while it is operating.

In a waveguide applicator a slot is cut in the side of the waveguide in such a way that the workpiece may be introduced into the waveguide. Usually slots are provided on either side of the waveguide so that the workpiece may be passed through the waveguide continuously. This type of device is useful for heating thin webs of preformed material but cannot be used conveniently to apply pressure to the workpiece. In addition there is a limit to the size of the workpiece that can be passed through the slots, and devices of this type generally are not useful for heating thick workpieces.

In horn type antenna applicators a horn type antenna is used to convert the microwave energy from a transverse electric or magnetic mode to a free space or transverse electromagnetic mode. With this type of applicator it is difficult to control or contain the energy, and it is not possible to heat thick workpieces evenly or to apply pressure to the workpiece during heating.

In Canadian Pat. No. 836,140 issued Mar. 3, 1970 to Her Majesty in right of Canada as represented by the National Research Council of Canada there is disclosed a microwave power applicator having a basic configuration which resembles an embodiment of the instant invention. However, in the microwave power applicator disclosed in this patent no attempt is made to substantially uniformly distribute across the central tube which carries the workpiece hot spots which will occur as a result of reflection standing wave patterns within the central tube.

SUMMARY OF THE INVENTION

In accordance with this invention there is provided apparatus for applying microwave power to a workpiece comprising a first hollow tube having an inlet end and an outlet end, the first tube being adapted to receive through its inlet end a workpiece to which microwave power is to be applied, the workpiece passing through the first tube where microwave power is applied thereto and exiting through the outlet end of the first tube; first and second hollow waveguide sections located on opposite sides of the first tube and communicating with the first tube to introduce microwaves into it; and means for supplying microwaves to the first and second sections to be propagated through the first and second sections for introduction into the first tube; the frequency of the microwaves, the width of the first tube measured between the first and second sections and the angles of inclination of the first and second sections with respect to the first tube being chosen such that the peak amplitudes of reflection standing waves created by introduction of microwaves into the first tube via the first and sections sections respectively are interleaved, thereby substantially uniformly distributing hot spots created by the standing waves across the width of the first tube.

BRIEF DESCRIPTION OF THE DRAWINGS

This invention will become more apparent from the following detailed description taken in conjunction with the appended drawings, in which.

DETAILED DESCRIPTION OF THE INVENTION INCLUDING THE PREFERRED EMBODIMENT

Figures 1, 2, 3:
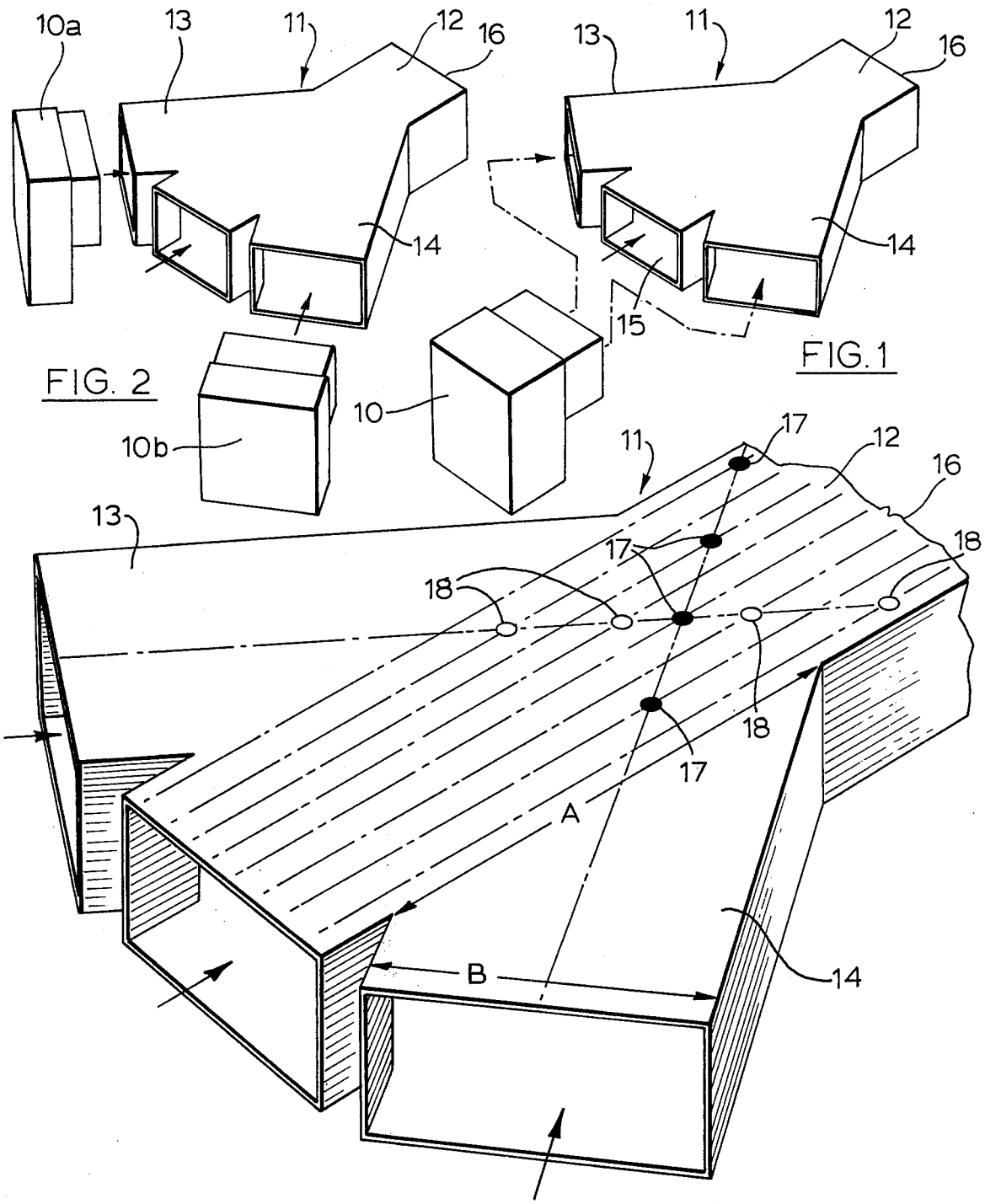
FIGS. 1 and 3 are perspective views of a microwave power applicator embodying the instant invention, and, FIG. 2 illustrates another and more preferred embodiment of the invention.

Referring to FIG. 1, there is shown a source 10 of microwave energy. Source 10 may be any conventional microwave energy source and, for industrial microwave applications, normally will operate at 915 MHz or 2450 MHz in accordance with D.O.T. and F.C.C. regulations. It may be, for example, an EIMAC (trade mark) Power Pack PPL-25. There is also shown what could be referred to as an applicator 11, the latter consisting of a hollow central tube 12 and two, hollow waveguide sections 13 and 14 located on opposite sides of central tube 12. Central tube 12 has an inlet end 15 and an outlet end 16 and is adapted to receive through its inlet end a workpiece to which microwave power is to be applied, the workpiece passing through central tube 12 where microwave power is applied thereto and exiting through outlet end 16. Central tube 12 conveniently may be a waveguide section itself but, in any event, is constructed so as to receive microwaves from waveguide sections 13 and 14 which are capable of propagating into the workpiece (not shown) being passed continuously through central tube 12. In the embodiment of the invention shown in FIG. 1 central tube 12 and waveguide sections 13 and 14 all are rectangular, each having two longer sides and two shorter sides. The longer sides of the central tube and the two waveguide sections lie in the same two planes, and waveguide sections 13 and 14 are affixed to the shorter sides of central tube 12. It would be possible, however, for central tube 12 to be rotated 90° so that sections 13 and 14 would be affixed to its longer sides. In the preferred embodiment of the invention, and as shown in FIGS. 1 and 3, waveguide sections 13 and 14 are each inclined at an acute angle to the longitudinal axis of central tube 12 and are located directly opposite each other. In a less preferred embodiment waveguide sections 13 and 14 each could be located perpendicular to the longitudinal axis of central tube 12. In another embodiment of the invention waveguide sections 13 and 14, rather than being located immediately opposite each other, could be located in staggered relationship with respect to each other. Moreover, if desired, more than one waveguide section could be affixed to each shorter side of central tube 12.

Waveguide sections 13 and 14 each are connected to microwave power source 10, this type of connection being conventional and being omitted for the sake of clarity, and microwaves may be supplied alternately or continuously from source 10 to waveguide sections 13 and 14. The embodiment of the invention illustrated in FIG. 2 differs from the embodiment of FIG. 1 in that two microwave sources 10*a* and 10*b* are provided, the latter being connected to waveguide section 14 and the former to waveguide section 13. In this embodiment of the invention, which is the preferred embodiment, the frequencies of the microwaves produced by sources 10*a* and 10*b* are different. The ramifications of this wall be outlined hereafter.

As noted hereinbefore waveguide sections 13 and 14 preferably each are inclined at an acute angle to the longitudinal axis of central tube 12 but may be perpendicular thereto. The former constitutes the preferred embodiment of the invention because the dimension A, as seen in FIG. 1, is considerably greater than the dimension B, so the energy density over the area constituted by A times the depth of central tube 12 is considerably less than the energy density over the area constituted by B times the depth of central tube 12, so that any tendency for arcing to take place would be reduced with waveguide sections 13 and 14 each inclined at an acute angle to the longitudinal axis of central tube 12. Moreover, with waveguide sections 13 and 14 each inclined at an acute angle to the longitudinal axis of central tube 12, there is a reduction in the tendency for microwave energy passing through the workpiece to be propagated through the waveguide on the opposite side of central tube 12, as would be the case if waveguide sections 13 and 14 were directly opposite each other and perpendicular to the longitudinal axis of central tube 12.

In practising this invention it is necessary for the microwaves to be propagated in waveguides 13 and 14 in the $TE_{no}$ mode, where $n$ is any number. In experiments which have been conducted to demonstrate the practicability of the invention, the $TE_{10}$ mode has been successfully utilized. It is to be understood with reference to the aforementioned nomenclature that in the $TE_{no}$ mode the electric field vector is parallel to the shorter sides of waveguide sections 13 and 14 and hence perpendicular to the longer sides thereof. The desired object is to obtain a field configuration within central tube 12 that is as uniform as possible. The microwave energy being supplied to the workpiece in central tube 12 from waveguide sections 13 and 14 is attenuated as it passes through the workpiece, and the magnitude of the E vector decreases logarithmically as the microwave energy propagates through the workpiece. There are, of course, two logarithmic attenuation curves, since microwave energy is applied to both sides of central tube 12. As far as the total heating effect is concerned, these two curves add together to produce substantially uniform heating across the workpiece.

Central tube 12 preferably is made sufficiently long so that at its outlet end 16 there will be substantially no energy to be reflected. This contributes to minimizing the occurrence of standing waves within central tube 12 caused by microwave propagation therein. Notwithstanding central tube 12 being designed so as to minimize reflections and thus the occurrence of standing waves, reflection standing wave patterns will necessarily be present within central tube 12, and there will be two such reflection standing wave patterns, one associated with each waveguide section 13 and 14. The location of the points of peak amplitude of the reflection standing wave pattern associated with waveguide section 14 are shown by the points designated 17 in FIG. 1, while the locations of the peak amplitudes of the reflection standing wave pattern associated with waveguide section 13 are shown by the points designated 18 in FIG. 1. The location of the points 17 and 18 which are closest to the side walls of central tube 12 opposite to waveguide sections 14 and 13 respectively will occur one quarter of a wavelength from the respective side walls of central tube 12 measured along the lines containing the points, the remaining points 17 and 18 occurring at half wavelength spacings. At the points where the reflection standing wave patterns have peak amplitude, hot spots will be created in the workpiece being processed. In accordance with this invention it has been discovered that by choosing the frequency of the microwaves, the width of central tube 12 as measured between waveguide sections 13 and 14 and the angles of inclination of waveguide sections 13 and 14 with respect to the longitudinal axis of central tube 12, the peak amplitudes of the reflection standing wave patterns created by introduction of microwaves into central tube 12 via waveguide sections 13 and 14 can be interleaved, thereby substantially uniformly distributing the hot spots created by the reflection standing wave patterns across the width of central tube 12. Thus, when the frequency of the microwaves are known, the location of the points 17 and 18 which are closest to the side walls of central tube 12 opposite to waveguide sections 14 and 13 will be known, as will the locations of the remaining points 17 and 18, and by varying either the angles of inclination of waveguide sections 13 and 14 with respect to the longitudinal axis of central tube 12 or the width of central tube 12, the locations of points 17 can be made to fall midway between two adjacent points 18 and vice versa when the points 17 and 18 are projected parallel to the longitudinal axis of central tube 12 onto a plane which is perpendicular to this longitudinal axis, as best shown in FIG. 3. Thus the hot spots created by the reflection standing wave patterns are distributed uniformly across central tube 12 and hence across the workpiece. It should be understood that the nature of the workpiece itself has some effect on the location of the reflection standing wave patterns, and it may be necessary to take this into consideration to achieve the desired interleaving. If desired, waveguide sections 13 and 14 may be affixed to central tube 12 by means of flexible sections, so that the angles of inclination of waveguide sections 13 and 14 with respect to the longitudinal axis of central tube 12 may be varied. Likewise, central tube 12 may be provided with an expansion joint to permit its width to be varied.

In using the apparatus shown in FIG. 1, it is first adjusted to uniformly distribute the hot spots across the width of central tube 12. The workpiece is inserted into inlet 15 and passes continuously through the central tube 12 emerging via outlet 16. Microwave power is applied thereto from source 10 or sources 10*a* and 10*b* via waveguide sections 13 and 14. A wide variety of workpieces may be heated by passage through central tube 12. Preferably the crosssectional area of the workpiece should be the same as the cross-sectional area of central tube 12 or the E field will be distorted. To this end, plywood sections have been processed in apparatus of the type described, the microwave energy being used to cure the resin used to laminate the veneers of the plywood, but many other applications are possible. For example, the apparatus could be used for curing rubber.

In the manufacture of plywood it is necessary to apply pressure to the plywood before the resin is cured. This can be achieved with apparatus embodying the instant invention by incorporating a press within central tube 12. The press may take the form of two moving belts suitably backed up and defining a nip between the belts into which the plywood is inserted. In fact, the belts could be fabricated of metal and cold constitute a part of central tube 12.

In the preferred embodiment of the invention two microwave power sources 10*a* and 10*b* are employed each operating at a different frequency. Whenever microwaves are applied to central tube 12 from both sides thereof, an interference standing wave pattern will be set up. If two microwave sources are employed operating at even slightly different frequencies, the interference standing wave pattern will not be static but will move back and forth across central tube 12. The hot spots created by this interference standing wave pattern thus will not be static and will not create any problem. In the case where microwave energy is applied alternately to waveguide sections 13 and 14 from a single source 10, there also will be no interference standing wave pattern produced. However, in the embodiment of the invention where microwaves of the same frequency, e.g. from a common source, are applied simultaneously to waveguide sections 13 and 14, a static interference standing wave pattern will result that cannot be compensated for. Consequently this is a less preferred embodiment of the invention.

While preferred and other embodiments of the invention have been described herein, those skilled in the art will appreciate that changes and modifications may be made therein without departing from the spirit and scope of this invention as defined in the appended claims.

What I claim is:

1. Apparatus for applying microwave power to a workpiece comprising a first hollow tube having an inlet end and an outlet end, said first tube being adapted to receive through said inlet end a workpiece to which microwave power is to be applied, said workpiece passing through said first tube where microwave power is applied thereto and exiting through said outlet end; first and second hollow waveguide sections located on opposite sides of said first tube and communicating with said first tube to introduce microwaves into said first tube; and means for supplying microwaves to said first and second sections to the propagated through said first and second sections for introduction into said first tube; the frequency of said microwaves, the width of said first tube measured between said first and second sections and the angles of inclination of said first and second sections with respect to said first tube being chosen such that the peak amplitudes of reflection standing waves created by introduction of microwaves into said first tube via said first and second sections respectively are interleaved, thereby substantially uniformly distributing hot spots created by said standing waves across the width of said first tube.

2. Apparatus according to claim 1 wherein said means for supplying microwaves is a single microwave power source communicating with both said first and second sections.

3. Apparatus according to claim 1 wherein said means for supplying microwaves comprises a first microwave power source communicating with said first section and a second microwave power source communicating with said second section, said power sources producing microwaves at different frequencies.

4. Apparatus according to claim 1 wherein said first and second sections are designed to propagate microwaves predominantly in the $TE_{no}$ mode where $n$ is any integer.

5. Apparatus according to claim 4 wherein $n$ is 1.

6. Apparatus according to claim 1 wherein said tube and said sections are rectangular each having two longer sides and two shorter sides, said longer sides of said tube and said sections lying in the same two planes and said first and second sections being affixed to said shorter sides of said first tube.

7. Apparatus according to claim 6 wherein said first and second sections are designed to propagate microwaves predominantly in the $TE_{no}$ mode where $n$ is any integer.

8. Apparatus according to claim 7 wherein $n$ is 1.

9. Apparatus according to claim 6 wherein said means for supplying microwaves comprises a first microwave power source communicating with said first section and a second microwave power source communicating with said second section, said power sources producing microwaves at different frequencies.

10. Apparatus according to claim 9 wherein said first and second sections are designed to propagate microwaves predominatly in the $TE_{no}$ mode where $n$ is any integer.

* * * * *